US005392471A

United States Patent [19]

Vos

[11] Patent Number: 5,392,471

[45] Date of Patent: Feb. 28, 1995

[54] WEIRS

[75] Inventor: Richard V. Vos, Randburg, South Africa

[73] Assignee: Prelude Pool Products C C, Randburg, South Africa

[21] Appl. No.: 131,688

[22] Filed: Oct. 6, 1993

[30] Foreign Application Priority Data

Oct. 7, 1992 [ZA] South Africa ..... 92/7703
Mar. 10, 1993 [ZA] South Africa ..... 93/1695

[51] Int. Cl.[6] ..... E04H 4/16

[52] U.S. Cl. ..... 4/507; 4/490; 210/169; 210/416.2

[58] Field of Search ..... 4/490, 512, 507, 508, 4/509; 210/169, 242.1, 416.2

[56] References Cited

U.S. PATENT DOCUMENTS 3,067,879 12/1962 Baker ..... 210/169 X
3,212,268 10/1965 Ortega ..... 210/169 X
3,306,448 2/1967 Baker ..... 210/169 X
3,508,661 4/1970 Diemond et al. ..... 210/169
3,620,372 11/1971 Ehret ..... 210/169
3,706,379 12/1972 Erlich ..... 210/169
4,737,279 4/1988 Lewis ..... 4/490 X
4,740,307 4/1988 Buelteman ..... 4/512 X
4,743,368 5/1988 Gates ..... 4/490 X
5,195,191 3/1993 Stefan et al. ..... 4/512 X

*Primary Examiner*—Robert M. Fetsuga
*Attorney, Agent, or Firm*—Marks & Murase; Michael D. Bednarek

[57] ABSTRACT

A closure device covers the inlet portal of a swimming pool weir. The closure device has a main opening that is controlled by a weir flap and a secondary opening to accommodate flexible piping leading to a pool cleaner, whereby water can be drawn into the weir simultaneously both through the flexible piping and the main opening. The weir flap has an elongated slot just below the upper edge.

15 Claims, 5 Drawing Sheets

WEIRS

This invention relates to swimming pool accessories.

BACKGROUND OF THE INVENTION

1. Field of the Invention
2. Description of Related Art

Most swimming pools have a weir in the form of a main chamber having an open top covered by a removable grid or lid (hereafter reference will only be made to the term "lid" for convenience), a suction port leading from the main chamber and being connected via suitable piping to a circulating pump and an inlet portal joining the main chamber to the pool, the level of the portal being such that, when the pool is filled with water, the level of the pool water is between the upper and lower extremities of the portal. Thus water is drawn into the chamber through the portal for circulation normally through, among other things, a filter and then returned to the pool at a position remote from the weirs. There are two main kinds of weir, viz a built-in weir and a molded plastic weir. In the latter case, the portal is in the form of a short tunnel. The water flow through the portal is normally controlled by a weir flap that is pivoted to the sides of the portal and that has the effect that the bulk of the water drawn into the chamber is the water at the surface of the pool.

Most modern pools are provided with automatic pool cleaners which are connected more or less permanently to the suction port through flexible piping, usually via a control valve which permits the ingress of water, so that water is drawn into the suction port through the weir as well as through the flexible piping. This piping normally enters the weir through the portal and thus inhibits the operation of the weir flap. Alternatively, the piping exits the chamber through the open top. While this permits the weir flap to operate, it is disadvantageous for a number of reasons, amongst which are that the piping will lie in the path of any person walking around the pool and that the lid must be removed so that the open top of the chamber will be unguarded.

SUMMARY OF THE INVENTION

According to one aspect of the invention there is provided a closure adapted to cover the portal of a swimming pool weir, the closure having a main opening that is controlled by a weir flap and a secondary opening to accommodate the flexible piping, whereby water can be drawn into the weir both through the flexible piping and the main opening.

The main opening is preferably rectangular and adapted to be mounted in a vertical position. Preferably the weir flap is pivotally mounted to the side of the main opening near its lower edge.

The secondary opening is preferably circular to receive therethrough the end of the flexible piping which connects to the suction port.

A closure plate is preferably provided to close the secondary opening when the piping for the automatic pool cleaner does not pass through the secondary opening. This closure plate is preferably pivoted about a connection located above the opening. A pin and one or more recesses are preferably provided on the plate and the closure to hold the plate in one of more of its fully open or fully closed positions.

The closure is preferably provided as a wall on a housing member. The housing member is preferably in the form of a passage leading from the main opening to within the weir chamber. This wall preferably has an extension to one side thereof, the secondary opening being formed in this extension.

A sealing collar is conveniently provided on the face of the closure closer to the weir chamber so that it, the closure, may be sealed against the wall of the pool about part or all of the portal.

According to another aspect of the invention there is provided a swimming pool with a weir as described above and a closure as mentioned above sealing the portal of the weir.

According to a further aspect of the invention there is provided a weir flap of the kind that controls the flow of surface water to the main chamber of a weir through the inlet portal, the weir flap being mounted near its lower edge to stand vertically in the water so that its upper edge, which is arranged horizontally, is above the level of the water in the pool and chamber and is capable of pivoting about its mounting to permit water to pass over the upper edge and into the chamber wherein a slot is provided below the upper edge so that water can pass therethrough even though the upper edge is above the level of the water in the chamber.

This slot is preferably arranged parallel to the upper edge and extends over about 65% to 80%, conveniently between 70% and 75% and preferably about 71% of the width of the plate. The upper edge of the slot is preferably about 10 to 20 millimeters below the upper edge of the plate and preferably about 15 millimeters therebelow. The upper part of the front face of the weir flap (i.e., the face closer to the pool) has a 45° chamfer from about 15 millimeters below the upper edge of the plate. A shallow arcuate scallop having a maximum depth at its center of about 5 millimeters is provided in the front face extending across approximately the entire width of the slot and continuing into the slot.

The width of the slot at its inlet is preferably greater than the width at its outlet being preferably about four times the latter. Preferably the lower edge of the slot outlet is above the upper edge of the slot inlet. An inclined surface leads from the lower edge of the slot inlet to the lower edge of the slot outlet, which surface preferably comprises two parts, an inlet part inclined at between about 55° and 65°, preferably about 60°, to the front face of the weir flap and an outlet part inclined at between about 25° and 35°, preferably about 30°, to the rear face of the weir flap.

It should be noted that in certain countries and under certain usages, the item which is described herein as a "weir" is known as a "skimmer". The language of the specification (including the claims) is to be construed accordingly.

BRIEF DESCRIPTION OF THE DRAWINGS

Embodiments of the invention will now be described by way of example with reference to the accompanying drawings.

In the drawings

DETAILED DESCRIPTION OF THE INVENTION

Figure 1:
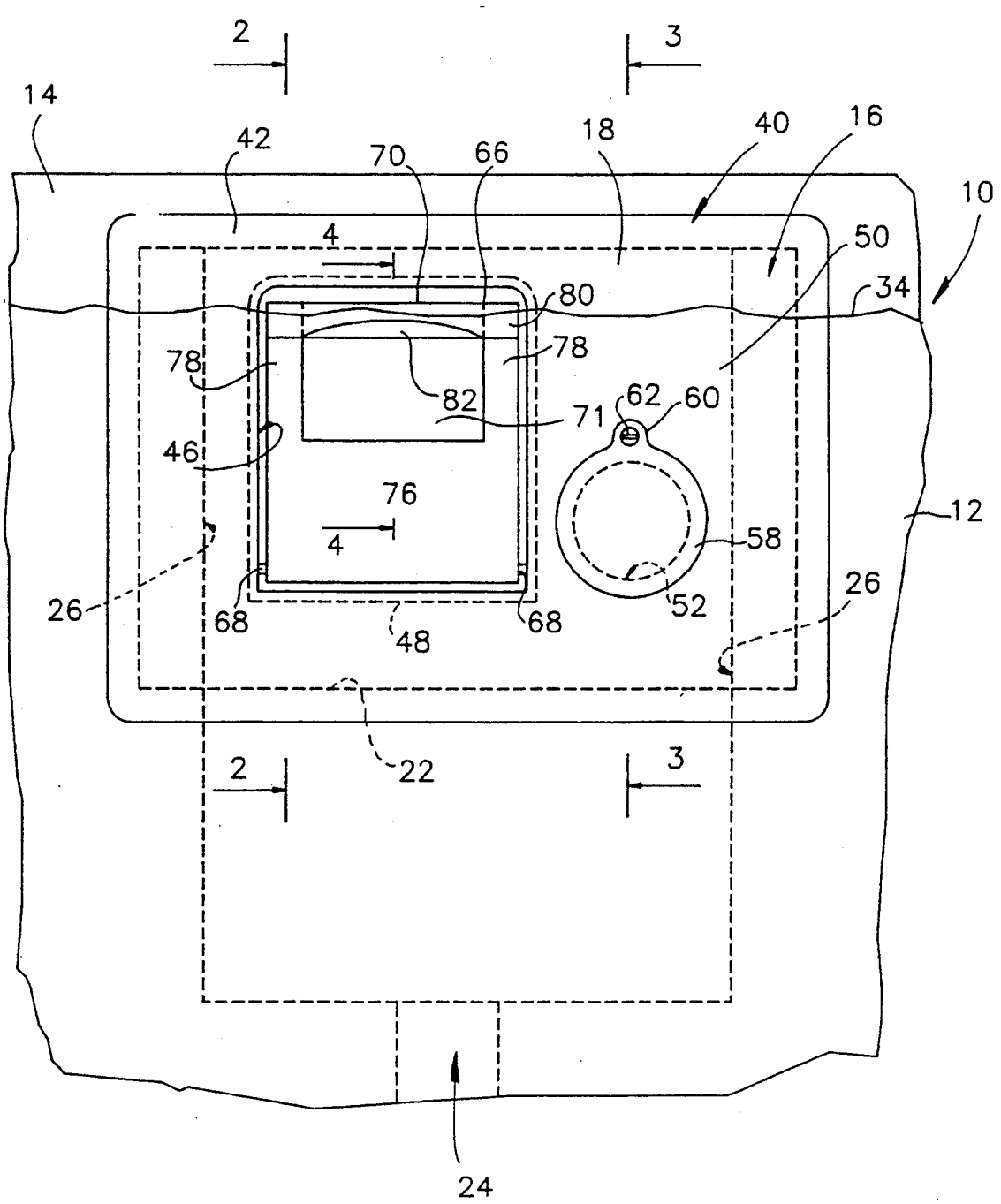
FIG. 1 is a detail view of the upper part of a wall of a swimming pool showing the weir with a closure of the invention without the automatic pool cleaner connected thereto.

Referring now to the drawings, there is shown a detail of a swimming pool 10 containing a body of water (indicated at 12). The pool 10 is bounded by a wall 14 which at the height of the water body 12 is provided with a weir 16.

Figure 2:
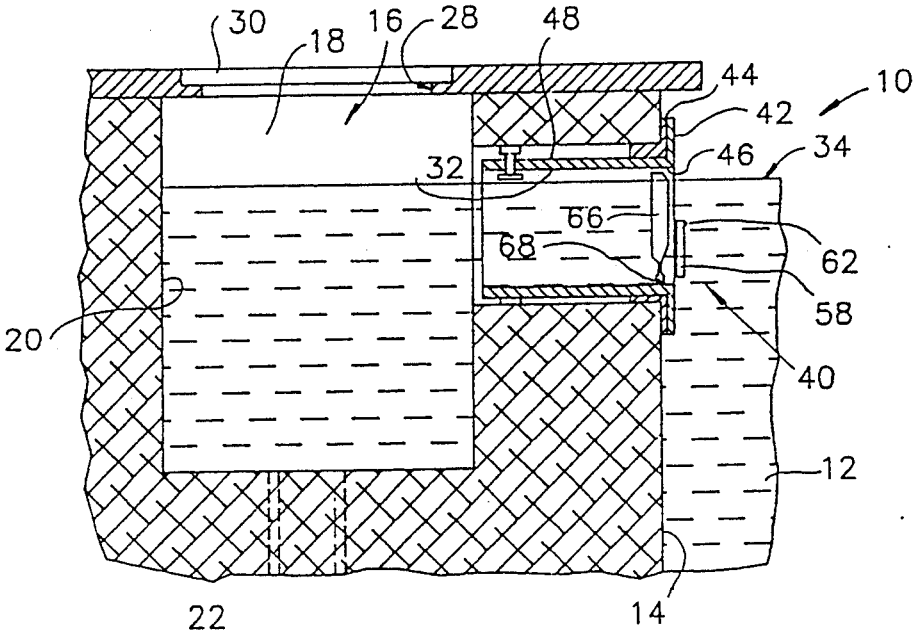
FIGS. 2 and 3 are respectively sections on lines 2—2 and 3—3, the latter showing the piping connected thereto.
Figure 3:
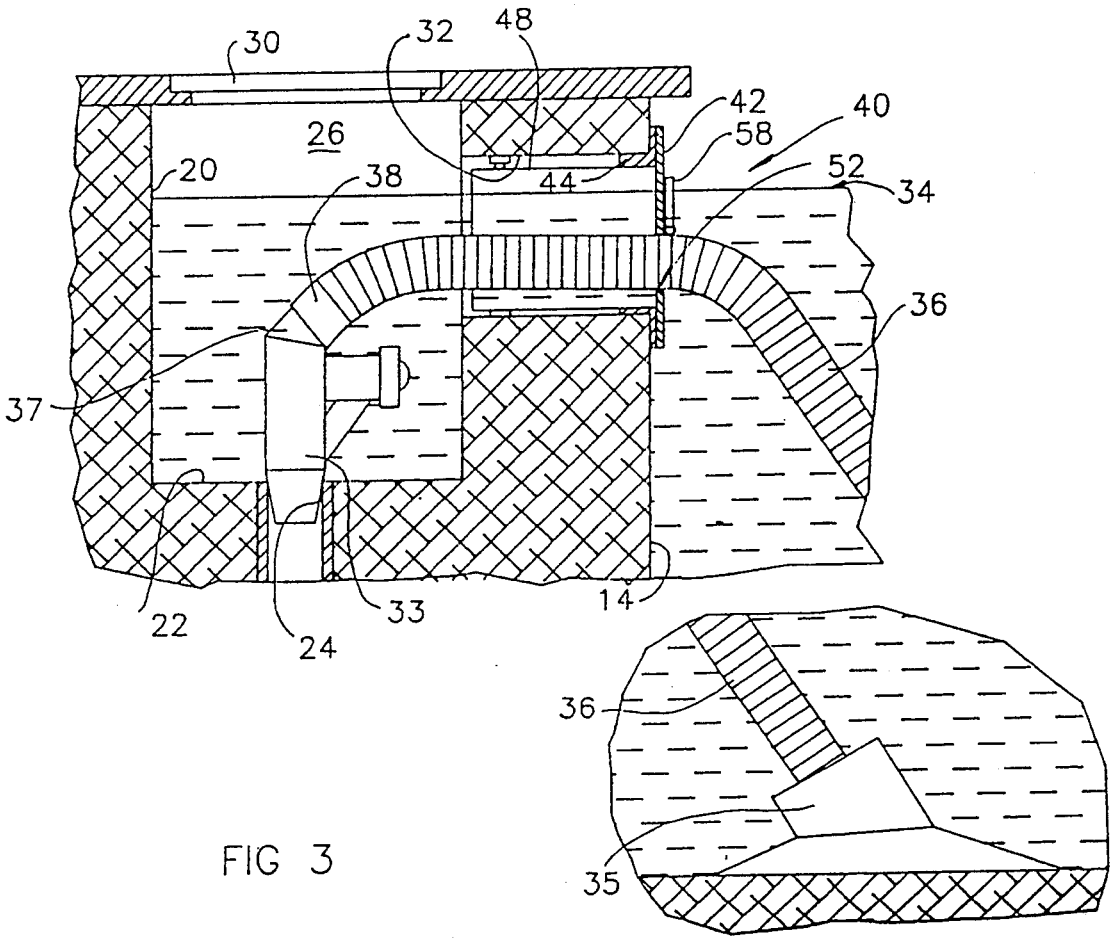
Figure 4:
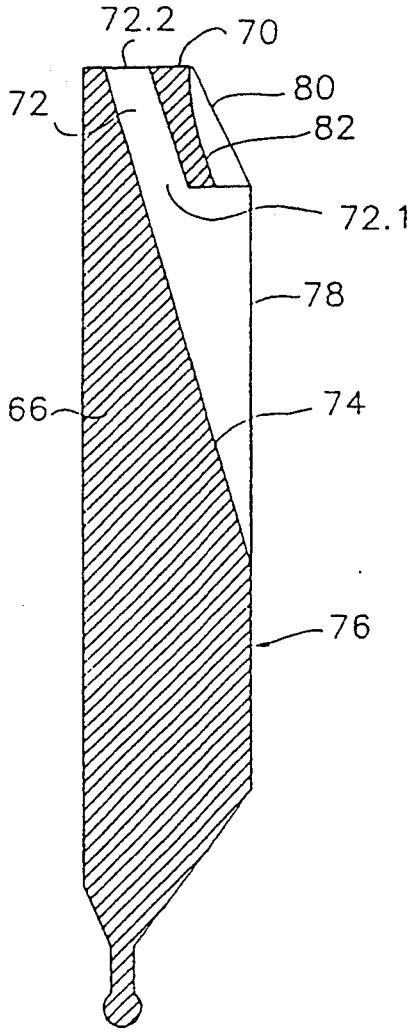
FIG. 4 is an enlarged detail section on line 4—4 of FIG. 1.

The weir 16 incorporates a cuboidal chamber 18 having a rear wall 20 (see FIGS. 2 and 3), a base 22 with a suction port 24 therein, two side walls 26, a top opening 28 closed by a removable lid 30 and a rectangular portal 32. A control valve 33 which is preferably as described in the specification of my co-pending patent application Ser. No. 08/131,689, filed Oct. 6, 1993 (the contents of which are incorporated herein by this reference) is provided in the suction port 24. The suction port 24 is connected to a circulating pump (not shown) through suitable piping so that water can be drawn from the body 12, passed through a leaf trap and a filter and then returned to the pool 10 at a location remote from the weir 16. The normal level of the water body 12 is such that its upper surface 34 is about midway of the height of the portal 32 or slightly thereabove.

Within the pool 10 is an automatic pool suction cleaner, shown diagrammatically at 35, which may be any one of the commercially obtainable cleaners such as those sold under the trade names "Kreepy Krawley", "Baracuda" and "Aquanaut". Flexible plastic piping 36 leads from the cleaner. This piping 36 comprises various sections which are connected together by nozzle and socket arrangements, a socket 38 being shown on the end section of the piping 36 receiving the nozzle 37 at the end of the control valve 33. As thus far described, the pool 10 and its contents are conventional.

A closure device 40 is provided for the weir 16. The device 40 is a plastics moulding. It comprises a rectangular closure plate 42 which is of greater area than the portal 32 and which rests against the wall 14 about the portal 32 to cover the latter. A layer 44 of sealing material is provided on the rear side of the plate 42 (i.e., the side closer to the weir chamber 18) and the wall 14 to seal the former against the latter.

Figure 6:
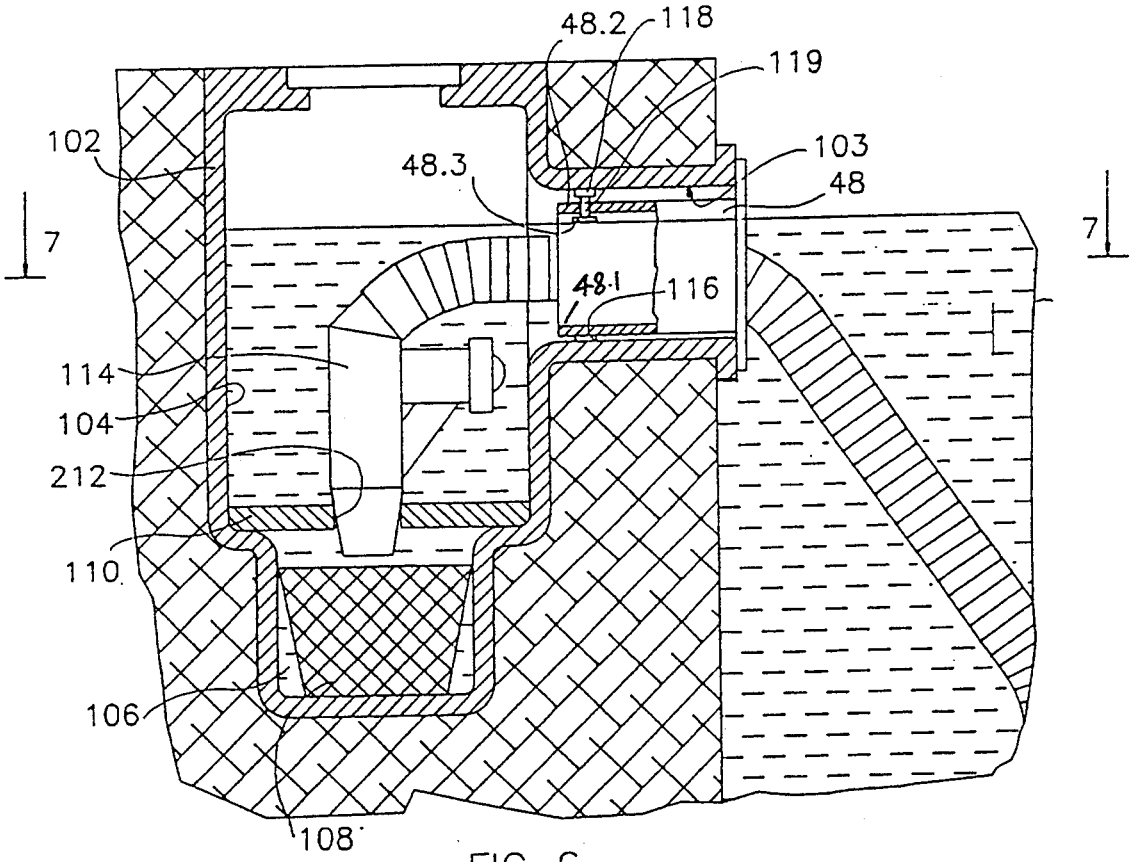
FIG. 6 is a section through another weir with a weir flap of the invention.

A main rectangular opening 46 of lesser horizontal than vertical dimensions is provided in the plate 42. The opening 46 extends over about two thirds of the width of the portal 32. On the rear side of the plate 42 is a rectangular passage 48 of about 186 mm axial length leading from the main opening 46. The passage 48 is of restricted cross-section as compared to the portal 32. Stops 116 and 118 described with reference to FIG. 6 are provided for the same purpose.

In the extension 50 of the closure plate 42; i.e. that part which extends to, the side of the passage 48, and near the lower edge thereof there is a secondary opening 52. This opening 52 is circular and of a dimension such that the piping 36 can pass closely therethrough.

A circular closure plate 58 is provided to close the circular opening 52 when the piping for the automatic pool cleaner is not connected thereto. This plate 58 has a small extension ear 60 at its upper portion. A bolt 62 passes through the ear 60 so that the plate 58 can swing from a closure position in which it lies coaxially over the opening 52 and an open position away from the opening 52 to permit the piping 36 to enter the opening 52.

Within the main opening 46 is a weir flap 66 which is formed as a plastics moulding having its front and rear faces parallel. The weir flap 66 is mounted on a pair of stub pins 68 at its lower edge which fit respectively into cylindrical recesses in the opening 46 so that it stands vertically in the water with its upper edge 70 above the level 34 of the water body 12 and is capable of pivoting to an inclined position below the water level 34 when water is been drawn to the control valve 33.

A central slot 72 extends approximately 70% of the width of the weir flap 66. The slot 72 has an elongated rectangular inlet port 72.1 on the front face of the plate 66 and a narrower outlet port 72.2 of the same width through the upper edge 70. An inclined lead-in surface 74 in the front face 76 of the weir flap 66 between two side wall parts 78 leads to the slot 72. The upper edge 70 of the front face 76 of the weir flap 66 has a 45° chamfer 80. An arcuate scallop 82 is provided in the front face 76 above, extending the length of and entering into the inlet port 72.

In use, when the automatic pool cleaner 35 is not connected, the closure plate 58 is in its closed position and the circulating pump is operating, water is drawn into the weir chamber 18 through the main opening 46 which is controlled by the weir flap 66 as above described. The effect of the weir flap 66 is to cause the water to be drawn in from the surface 34 of the water body 12. This tends to remove matter floating on the water surface 34 before it becomes water logged and sinks to the bottom of the pool.

When it is desired to connect the automatic pool cleaner, the closure plate 58 is moved to its open position and the piping 36 is passed through the secondary opening and the socket 38 is connected to the cranked inlet nozzle 37 of the control valve 33. Now water will be drawn into the suction port 24 both through the piping 36 and the control valve 33, the proportions of the amounts of water being drawn into the chamber 18 will be controlled by control valve 33. It will be seen that the water being drawn into the chamber 18 through the main opening 46 will continue to be controlled by the weir flap 66. Thus the benefits of the weir flap 66 will not be sacrificed when the automatic pool cleaner is connected and the piping 36 will enter the body of water 12 directly, always being below the water level 34.

Figure 5:
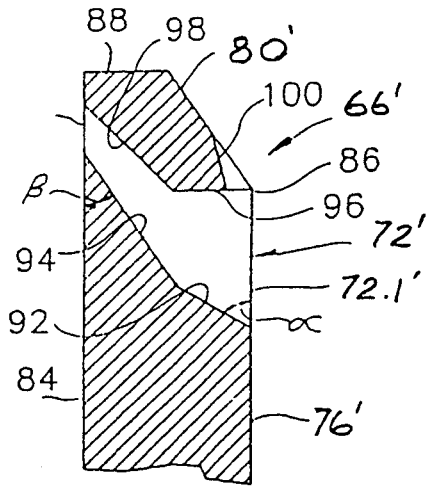
FIG. 5 is a similar section of a modified weir flap.

Referring now to FIG. 5 there is shown a modified weir flap 66' which is a plastics moulding with its front and rear faces 76' and 84 parallel. It is 120 mm wide, 140 mm high and 26.6 mm thick. Its height depends upon the height of the portal. The construction of the lower portion of the weir flap is such as to accommodate the pivoting connection to the portal in known manner.

The upper edge of the front face 76' of the weir flap 66' (which is adjacent the pool 10) has a 45° degree chamfer 80'. Below the chamfer 80' there is a central slot 72' passing through the weir flap 66'. The slot 72' has an elongated rectangular inlet port 72.1' on the front face 76' of the weir flap 66' and an outlet port 72.2' on its rear face 84. The port 72.1' has its upper edge 86 spaced 40 mm from the upper edge 88 of the plate. The length of the slot 72' is such that it extends approximately 70% of the width of the weir flap 66' and its width is 23 mm. The outlet port 72.2' is of the same width as the inlet port 72.1' and is 5.5 mm wide. It is offset closer to the plate edge 88 relative to the port 72.1 as will become apparent.

The base of the slot 72.1' (i.e. the part joining 72' the two lower edges of the two ports 72.1' and 72.2') comprises two surfaces 92 and 94. The surface 92 is at an angle $\alpha$ of 60° to the front face 76' and the surface 94 is at an 76' angle $\beta$ of 30° to the rear face 84. The depth of these two surfaces through the thickness of the weir flap are approximately the same. The upper edge 86 of the port 72.1' is constituted by a surface 96 at right angles to the front face 76' extending downwardly by 14.3 mm. The surface 96 joins a top surface 98 that extends at 45° to the rear face 84. Both the ports 72.1' and 72.2' are below the level of the water body 12 when the weir flap 70 is vertical.

An arcuate scallop 100 is provided in the front face above, extending the length of and entering into the port 72.1'. At the center of the port 72.1', the scallop 100 is at its deepest and extends 6 mm into the body of the wier flap 66'. The scallop 100 is centred on an axis which converges (at a significant distance beyond its upper edge) to the plane containing the front face so that it is deeper in the chamfer 74.

Figure 7:
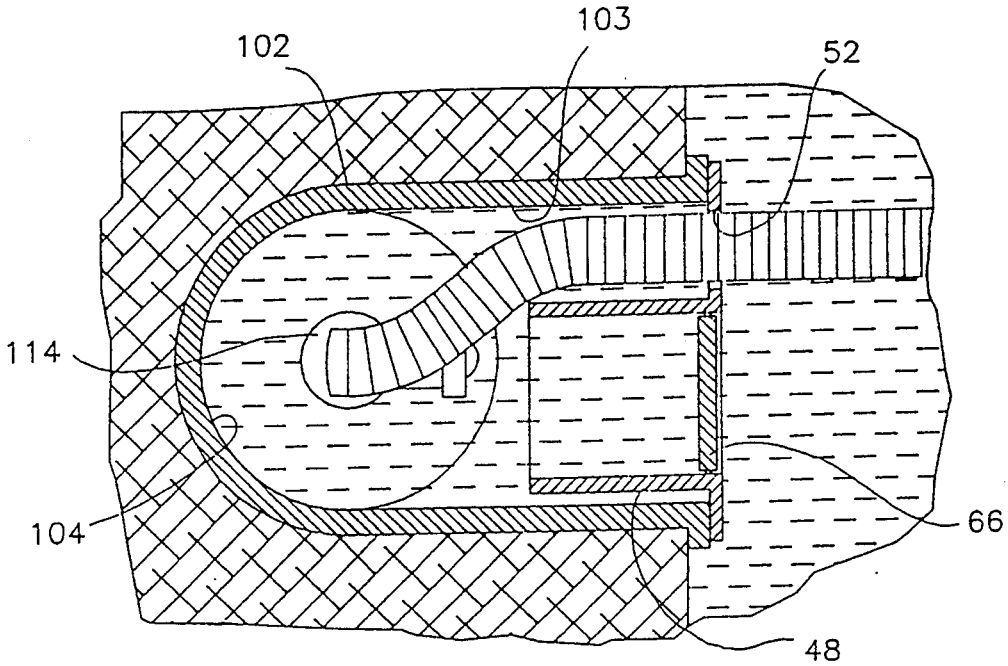
FIG. 7 is a section on line 7—7 of FIG. 6.

Reference is now made to FIGS. 6 and 7. In these drawings the weir is a molded plastics weir or skimmer 102 of any well-known kind and, for example, a skimmer as produced by Hayward Pool Products, Inc or American Products.

This skimmer 102 has a rectangular section inlet tunnel 103 leading to a main cylindrical chamber 104 located about a leaf trap chamber 106 containing a leaf trap 108 and having an outlet leading to a pump and filter in known manner. A separator plate 110 is provided between the chambers 104 and 106. This plate 110 has a central opening 212 which constitutes the suction port of the skimmer 102. The outlet nozzle end of a control valve 114 is connected to this suction port.

The weir is mounted so that the tunnel 104 is at the level of the water in the pool and constitutes a portal for the weir. A closure device is provided for this inlet portal. The closure device is (save as will be described below) identical to the closure device 40 described above. The closure device and its parts are indicated by the same references as have been used above.

The passage 48 fits within the inlet portal 104 with small clearance between the upper and lower surfaces of the portal and with adequate space on the side of the passage for the flexible piping. The lower surface 48.1 of the passage 48 carries a pair of rubber stops 116 which rest on the lower surface of the portal 104. A pair of stops 118 are carried respectively on threaded bolts 119 that project through the upper surface 48.2 of the passage 48. The heads 48.3 of the bolts are within the passage to enable an installer to rotate the bolts to extend them outwardly of the passage so that the passage 48 is clamped in the portal and hence the closure device 40 is secured to the weir.

The flexible pipe enters skimmer 102 through the opening 52 and is secured to the inlet to the control valve 114. This arrangement operates in the same manner as the that described above.

Figure 8:
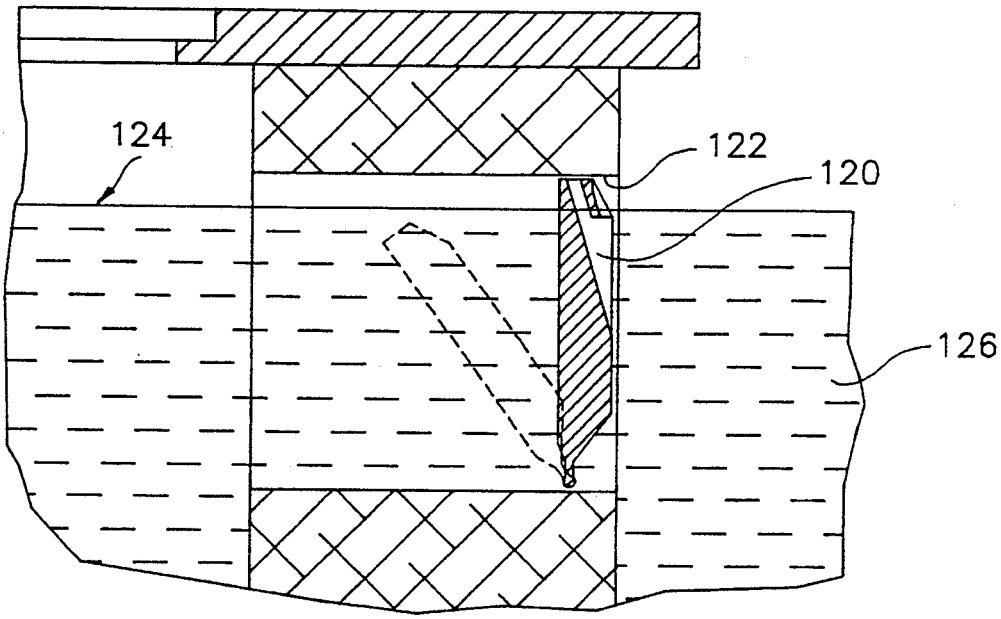
FIG. 8 is a section through a weir with another weir plate.
Figure 9:
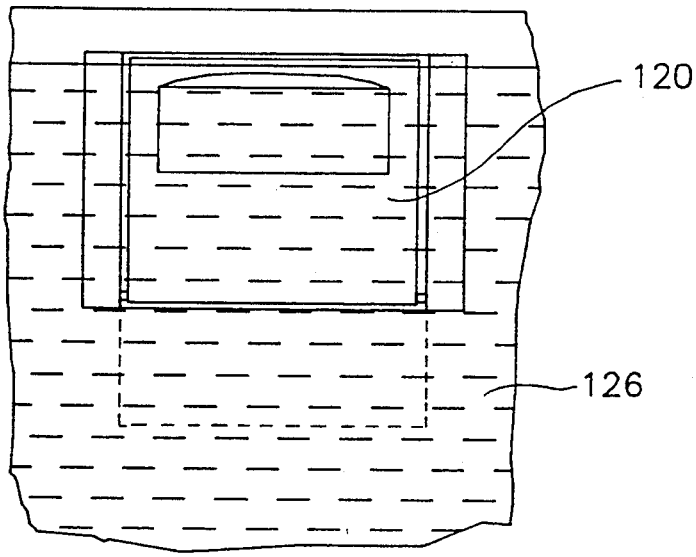
FIG. 9 is a front view of the weir of FIG. 8.

Reference is now made to FIG. 8 which shows a weir flap 120 in position in the inlet portal 122 of a skimmer or weir 124 of a swimming pool (indicated generally at 126). The weir flap 120 is of identical construction to the weir flap 66 or 70 save that it is of sufficient size to fill the portal substantially (i.e., there is sufficient space between the edges of the weir flap and the sides of the portal).

We have found that the weir flaps above described greatly improve the surface water flow into the weir chamber 128 (either directly or indirectly as the case may be). The water appears to enter at a greater velocity than with normal weir flaps. Furthermore, the water passing through the slot 72 forms a jet which improves water flow in the chamber. We further found that the scallop also improves the water flow into the chamber. Thus, we have found, the surface of the water in the pool is more quickly circulated and tends to be considerably cleaner than is achieved when a conventional weir flap is used.

This invention is not limited to the precise constructional details hereinbefore described and illustrated in the drawings. The dimensions of the weir flap and other parts may vary to suit the size of the weir and weir portal and for other reasons. The various proportions mentioned, may also vary. Instead of the closure plate 42 being adhered to the wall 14, a collar may be provided around the passage to seal against the inside walls of the portal.

A boss of resilient material may be provided at the secondary opening of the closure device, normally on the side of the closure remote from the body of pool water to seal against the piping. A raised dimple (not shown) on the rear face of the closure plate 58 may be provided to engage in either of two recesses not shown lightly to hold the plate 58 selectively in either the open or closed positions. Rubber sealing means (not shown) may be provided on the rear face of the plate 58 so as to provide a form of seal between it and the closure plate 42.

I claim:

1. A closure device adapted to cover the portal of a swimming pool weir, the closure device having:

a closure plate for covering the weir portal;

a main opening in the closure plate that is controlled by a weir flap;

walls defining a tunnel that is restricted in cross-section as compared to the weir portal and that leads from the main opening into the weir; and a secondary opening in the closure plate beside the main opening to accommodate flexible piping leading to a pool cleaner, whereby water can be drawn into the weir simultaneously both through the flexible piping and the main opening.

2. A closure device as claimed in claim 1, wherein the secondary opening is circular receive therethrough the end of the flexible piping.

3. A closure device as claimed in claim 1, in which the weir flap has front and rear surfaces, a lower portion and an upper edge, pivot means at the lower portion of the flap, and a slot is provided having an inlet in the front surface of the weir flap extending parallel to the upper edge.

4. A closure device as claimed claim 3, wherein the slot is arranged parallel to the upper edge and extends over about 65% to 80% of the width of the weir flap.

5. A closure device as claimed claim 3, wherein a shallow arcuate scallop having a maximum depth at its center of about 5 millimeters is provided in the front surface of the weir flap extending across approximately the entire width of the slot and continuing into the slot.

6. A closure device as claimed in claim 3, in which the outlet from the slot is provided in said upper edge of the weir flap.

7. A weir flap as claimed in claim 3, in which there is a lead-in surface leading to the inlet to the slot, which lead-in surface is inclined to the said front surface.

8. A weir flap as claimed in claim 3, in which the slot is located centrally of the front surface and being less long than the width of the weir flap.

9. A closure device as claimed in claim 1, in which the weir flap has an upper edge and a slot having an inlet located below said upper edge so that water can pass therethrough.

10. A closure device as claimed in claim 1, further comprising clamping means located on the walls remote from the closure plate for clamping the device in the weir.

11. A closure device as claimed in claim 1, in which the walls comprise upper and lower walls and side walls, said walls being arranged to form a rectangular tunnel.

12. A closure device as claimed in claim 11, further comprising clamping means located on said upper and lower walls at locations remote from the closure plate for clamping the device in the weir.

13. A closure device as claimed in claim 11, further comprising a pair of stops located on the lower wall at a location remote from the closure plate and a pair of further stops carried respectively on threaded bolts that threadedly engage the upper wall at a location remote from the closure plate, said further stops being movable outwardly of the upper wall on rotation of the bolts to clamp the device in the weir.

14. A closure device as claimed in claim 1, in which the main opening is formed wholly within the closure plate.

15. A swimming pool comprising:

a main water reservoir;

a weir connected to the main water reservoir;

a portal providing communication between the main water reservoir and the weir; and a closure device including a closure plate for covering the weir portal, a main opening in the closure plate that is controlled by a weir flap, walls defining a tunnel that is restricted in a cross-section as compared to the weir portal and that leads from the main opening into the weir, and secondary opening in the closure plate beside the main opening to accommodate flexible piping leading to a pool cleaner, whereby water can be drawn into the weir simultaneously both through the flexible piping and the main opening.

* * * * *